US008001811B2

(12) United States Patent
Hahm et al.

(10) Patent No.: US 8,001,811 B2
(45) Date of Patent: Aug. 23, 2011

(54) WASHING MACHINE HAVING WATER SOFTENING DEVICE

(75) Inventors: Jung Yoon Hahm, Yongin-si (KR); Eduard Kuzgi, Suwon-si (KR); Jin Ha Jeong, Yongin-si (KR); Hideo Nojima, Seongnam-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 388 days.

(21) Appl. No.: 12/078,946

(22) Filed: Apr. 8, 2008

(65) Prior Publication Data

US 2008/0282749 A1 Nov. 20, 2008

(30) Foreign Application Priority Data

May 16, 2007 (KR) ..... 10-2007-0047616
May 30, 2007 (KR) ..... 10-2007-0052498

(51) Int. Cl.
*D06F 29/00* (2006.01)
*D06F 35/00* (2006.01)

(52) U.S. Cl. ..... 68/13 A; 68/17 R

(58) Field of Classification Search ..... 68/13 A, 68/17 R
See application file for complete search history.

(56) References Cited

U.S. PATENT DOCUMENTS 2,583,522 A * 1/1952 Winslow et al. ..... 210/223
3,669,274 A 6/1972 Happ et al.
3,875,061 A * 4/1975 Palma ..... 210/223
4,216,092 A * 8/1980 Shalhoob et al. ..... 210/222
4,320,003 A * 3/1982 Sanderson et al. ..... 210/222
4,659,479 A * 4/1987 Stickler et al. ..... 210/695
4,662,314 A * 5/1987 Moore, Jr. ..... 122/379
4,879,045 A * 11/1989 Eggerichs ..... 210/695
5,500,121 A * 3/1996 Thornton et al. ..... 210/222
5,675,153 A * 10/1997 Snowball ..... 250/438
5,682,774 A * 11/1997 Baumgartner ..... 68/235 R
5,837,143 A * 11/1998 Mercier ..... 210/695
6,250,118 B1 * 6/2001 Kim ..... 68/17 R
2005/0252533 A1 * 11/2005 Baeck et al. ..... 134/26

FOREIGN PATENT DOCUMENTS

CN 2403776 11/2000
CN 2485322 4/2002
DE 296 05 584 U1 7/1996
DE 198 14 884 A1 10/1999
DE 19814884 A1 * 10/1999
DE 10154471 A1 * 5/2002

(Continued)

OTHER PUBLICATIONS

DE 198 14 884 Machine Translation.*

(Continued)

*Primary Examiner* — Michael Barr
*Assistant Examiner* — Charles W Kling
(74) *Attorney, Agent, or Firm* — Staas & Halsey LLP

(57) ABSTRACT

A washing machine having a water softening device which improves the solubility of a detergent and a water softening performance concurrently. The washing machine includes a tub; a water supply device for supplying water to the tub; a detergent supply device for supplying a detergent to the tub; and a water softening device for softening the water. The water softening device is disposed such that the water supplied from the water supply device can be mixed with the detergent supplied from the detergent supply device and then the water mixed with the detergent can be supplied to the water softening device.

16 Claims, 7 Drawing Sheets

FOREIGN PATENT DOCUMENTS

| | | | |
|---|---|---|---|
| EP | 425815 | A2 * | 5/1991 |
| WO | 00/64325 | | 11/2000 |
| WO | 2006/079417 | A1 | 8/2006 |

OTHER PUBLICATIONS

DE 198 14 884 English Translation.*

DE 198 14 884 Machine Translation Oct. 1999 Bayer.*

European Search Report mailed on Aug. 21, 2009 in corresponding European Patent Application 08153941.3.

Chinese Office Action dated Nov. 19, 2010, issued in Chinese Patent Application No. 200810092181.X.

* cited by examiner

WASHING MACHINE HAVING WATER SOFTENING DEVICE

CROSS-REFERENCE TO RELATED APPLICATIONS

This application claims the benefit of Korean Patent Application Nos. 10-2007-0047616, filed May 16, 2007, and 10-2007-0052498, filed on May 30, 2007 in the Korean Intellectual Property Office, the disclosures of which are incorporated herein by reference.

BACKGROUND

1. Field

The present invention relates to a washing machine, and more particularly, to a washing machine having a water softening device.

2. Description of the Related Art

In general, water, and particularly underground water, contains a large quantity of minerals such as calcium, magnesium, etc. A numerical value obtained by digitizing the total amount of calcium, magnesium, etc. is referred to as hardness. Water having a high hardness is referred to as hard water, and water having a low hardness is referred to as soft water.

When tea is made using hard water, i.e., water having a high hardness, the tea tastes bitter. Further, when hard water flows in a pipe, the hard water generates scale on the inner surface of the pipe and thus reduces heat transfer performance and flow characteristics of a fluid. In the case that the scale is not removed periodically, the pipe may be broken.

Further, in the case that hard water is used in a washing machine, the hard water reacts with soap and thus lowers detergency, and in the case that hard water is used in a steam generating unit or a heater in a washing machine, the hard water generates scale and thus lowers energy efficiency and causes clogging of a nozzle.

That is, when hard water is used in a washing machine using water, washing power is lowered and a large quantity of scale is accumulated on a channel passing water, and thus the reliability of a washing machine product is lowered.

In order to solve the above problem, a washing machine having a water softening device using ion exchange resin and a washing machine having a water softening device using capacitive deionization have been proposed.

A water softening method using ion exchange resin is that water is softened by exchanging Ca2+ and Mg2+ ions, i.e., hard water components, contained in water, with Na+ ions of NaCl implanted in the ion exchange resin. A water softening device using the above ion exchange resin has a large volume, and thus it is difficult to install the water softening device in a compact-sized washing machine. Further, this water softening device requires periodic NaCl implantation, and replacement of the ion exchange resin with a new one due to impurities contained in water, thus increasing expenses.

In order to solve the above problem of the water softening method using ion exchange resin, Korean Utility Model Publication No. 1990-0005239 discloses an apparatus for manufacturing magnetized water, which softens water by magnetization treatment.

The above apparatus for manufacturing magnetized water, disclosed in the above Korean Utility Model, includes a magnetic field forming unit having magnets having a rectangular or circular-shaped cross section separated outwardly from the outer circumference of a pipe, in which natural water flows, at a regular interval, and a horseshoe magnet closely fixed to the magnets, such that the natural water flowing in the pipe at a regular current speed is magnetized by a magnetic field generated by the magnetic field forming unit.

However, since the magnetic field forming unit is provided at the outside of the pipe, the magnetic flux of the magnetic field forming unit cannot be concentrated on water to be softened. Thus, the above-disclosed apparatus for manufacturing magnetized water has a low water softening efficiency.

Further, since the pipe is configured such that the natural water flows in the pipe at a regular current speed, the flux state of the natural water flowing in the pipe is stabilized and the natural water cannot be sufficiently magnetized by the magnetic field formed by the magnetic field forming unit. Thus, the above-disclosed apparatus for manufacturing magnetized water has a low water softening performance.

Capacitive deionization (hereinafter, referred to as "CDI") is a regenerating operation that is performed by applying a proper voltage to a plurality of porous electrodes and causing water containing ions to flow between the porous electrodes such that positive ions are attracted to a cathode and negative ions are attracted to an anode so as to remove ion components from a medium, and then by applying opposite voltages to the electrodes saturated with the positive and negative ions or short-circuiting the electrodes so as to separate the ions from the electrodes. Korean Patent Laid-open Publication No. 2000-000060149 discloses a washing machine having a water softening device using CDI.

The above water softening device using CDI is expensive and has a relatively small amount of water to be treated, compared with the water softening device using ion exchange resin, thus being ineffective in a washing machine requiring rapid supply of a large amount of water.

Washing machines having the above-described water softening devices soften water supplied from a water supply source and then mix the obtained soft water with a detergent, and supply the water mixed with the detergent to a tub, thus lowering a water softening performance. Further, these washing machines have a water supply time longer than a detergent supply time, and cause the water to be mixed with the detergent supplied from a detergent supply unit and then to be supplied directly to the tub without dissolving the detergent in the water, thus lowering the solubility of the detergent.

SUMMARY

Therefore, one aspect of the invention is to provide a washing machine having a water softening device, which improves the solubility of a detergent and a water softening performance concurrently.

Another aspect of the invention is to provide a washing machine having a water softening device, which has a compact size.

Yet another aspect of the invention is to provide a washing machine having a water softening device which excludes any subsidiary action, such as salt exchange or regenerating operation.

In accordance with one aspect, the present invention provides a washing machine including a tub; a water supply device for supplying water to the tub; a detergent supply device for supplying a detergent to the tub; and a water softening device for softening the water, wherein the water softening device is disposed such that the water supplied from the water supply device can be mixed with the detergent supplied from the detergent supply device and then the water mixed with the detergent can be supplied to the water softening device.

The water supply device may include a first water supply pipe connecting a water supply source and an inlet of the detergent supply device, and a second water supply pipe connecting the detergent supply device and the tub, and the water softening device is installed at the middle of the second water supply pipe.

The water supply device may include a first water supply pipe connecting the detergent supply device and the tub, and a second water supply valve connecting a water supply source and the first water supply pipe, and the water softening device is installed below a junction part between the first and second water supply pipes.

A detergent supply valve for controlling the amount of the detergent supplied from the detergent supply device may be provided in the first water supply pipe above the junction part.

The washing machine may further include a control unit for controlling the opening degree of the detergent supply valve according to the amount of the water supplied from the second water supply pipe.

The water softening device may include a water softening pipe, in which the water mixed with the detergent flows, and a water softening unit for softening the water flowing in the water softening pipe.

The water softening unit may include an electromagnet surrounding the outer surface of the water softening pipe for supplying magnetic force and heat to a fluid, and a plurality of metal pipes provided in the water softening pipe and reacting with the electromagnet to magnetize the water.

The water softening unit may include an ultraviolet and/or infrared generator provided in the water softening pipe for generating ultraviolet and/or infrared rays.

The water softening unit may include a warm current generator for generating a warm current, and a heater for heating the water flowing in the water softening pipe.

The water softening device may further include an impeller for generating a forcible flow to prevent the accumulation of scale on the inside of the water softening pipe.

The impeller may be an axial flow fan forming a water current, which moves forward in a spiral, to move hard water components to the outer circumference of the water softening pipe.

A soft water discharge hole may be formed through the center of an outlet of the water softening pipe, and a hard water discharge hole may be formed through the outlet of the water softening pipe in the circumferential direction of the soft water discharge hole.

The water softening device may include a tubular body having magnetic force, a magnet provided in the tubular body, and vortex forming parts for forming vortexes and magnetizing water flowing in the tubular body so as to improve a water softening performance.

The vortex forming parts may be provided on at least one of the tubular body and the magnet.

The vortex forming parts may have the shape of a plurality of tapered pieces.

The vortex forming parts may have a saw-toothed or uneven shape.

Additional aspects and/or advantages will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
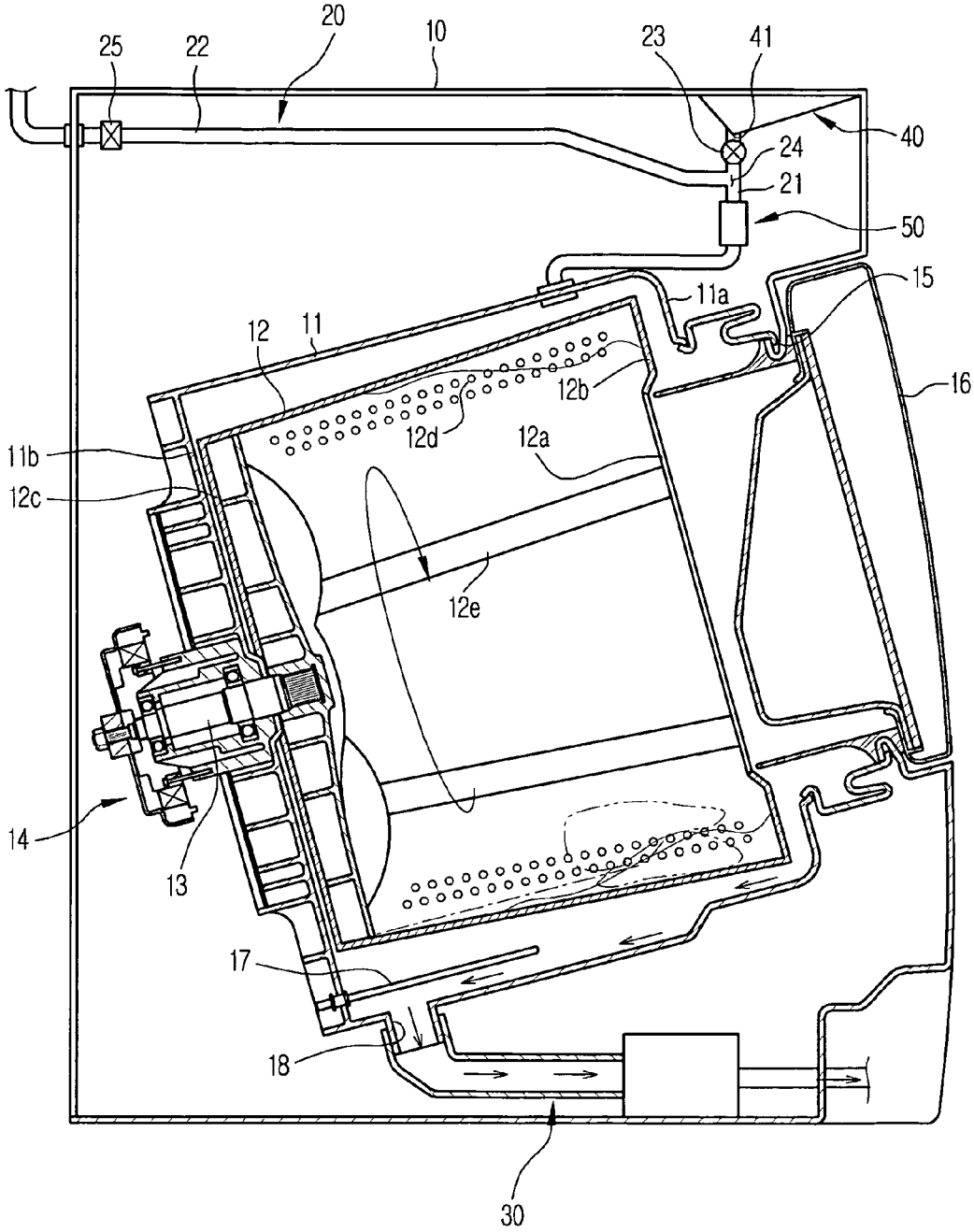
FIG. 1 is a schematic cross-sectional view of a washing machine in accordance with one embodiment of the present invention.

Reference will now be made in detail to the embodiments of the present invention, an example of which is illustrated in the accompanying drawings, wherein like reference numerals refer to like elements throughout. The embodiments are described below to explain the present invention by referring to the annexed drawings.

FIG. 1 is a schematic cross-sectional view of a washing machine in accordance with one embodiment of the present invention.

The washing machine in accordance with one embodiment of the present invention, as shown in FIG. 1, includes a main body 10 forming the external appearance of the washing machine, a cylindrical tub 11 installed in the main body 10 for containing washing water, a rotary drum 12 rotatably installed in the tub 11, a water supply device 20 for supplying the washing water to the inside of the tub 11, a water drain device 30 for discharging the washing water in the tub 11 to the outside, a detergent supply device 40 for supplying a detergent to the inside of the tub 11, and a water softening device 50 for softening the washing water flowing into the tub 11.

The tub 11 provided in the main body 10 is inclined such that a front surface 11*a* of the tub 11 provided with an entrance is located at a higher position than that of a rear surface 11*b* of the tub 11, and the rotary drum 12 installed in the tub 11 is inclined in the same manner as the tub 11 such that a front surface 12*b* of the rotary drum 12 provided with an entrance 12*a* is located at a higher position than that of a rear surface 12*c* of the rotary drum 12.

Here, a rotary shaft 13 connected to the center of the rear surface 12*c* of the rotary drum 12 is rotatably supported by the rear central portion of the tub 11, and thus the rotary drum 12 is rotatable in the tub 11.

Further, a plurality of through holes 12*d* is formed through the circumferential surface of the rotary drum 12, and a plurality of lifters 12*e* for raising and dropping laundry, when the rotary drum 12 is rotated, are installed on the inner surface of the rotary drum 12.

A motor 14, which rotates the rotary shaft 13 connected to the rotary drum 12, is installed at the outside of the rear surface 11*b* of the tub 11.

An opening 15 is formed through the front surface of the main body 10 at a location corresponding to the entrance 12*a* of the rotary drum 12 and the entrance of the tub 11 such that laundry can be put into or taken out of the rotary drum 12 through the opening 15. A door 16 for opening and closing the opening 15 is installed at the opening 15.

The detergent supply device 40 for supplying the detergent to the inside of the tub 11, the water supply device 20 for supplying water to the inside of the tub 11, and the water softening device 50 for softening the water supplied to the tub 11 are installed above the tub 11, and the drain device 30 for draining the water from the tub 11 is installed below the tub 11.

Reference numeral 17 represents a heater for heating the washing water, and reference numeral 18 represents a drainage hole for discharging the washing water to the drain device 30.

The detergent supply device 40 has a receipt space for containing the detergent therein. The receipt space is inclined such that the detergent held in the receipt space can be easily discharged, and a discharge hole 41 is provided at the lower end of the inclined surface of the receipt space.

The detergent supply device 40 is installed on the front surface of the main body 10 such that a user can easily put the detergent into the detergent supply device 40, and can receive detergents of various kinds, such as a liquid detergent and a powdered detergent.

The water supply device 20 includes a first water supply pipe 21 connecting the detergent supply device 40 and the tub 11 so as to supply the detergent of the detergent supply device 40 to the tub 11, and a second water supply pipe 22 for supplying water, supplied from an external water supply source, to the tub 11.

A detergent supply valve 23, the opening degree of which is controllable so as to regulate the amount of the detergent discharged from the discharge hole 41 of the detergent supply device 40, is provided at the middle of the first water supply pipe 21, and a junction part 24, at which the first and second water supply pipes 21 and 22 meet each other so that the water flowing from the second supply pipe 22 can join the detergent of the first water supply pipe 21, is formed below the detergent supply valve 23.

The water softening device 50 for softening the washing water, obtained by mixing water and the detergent, is provided below the junction part 24 of the first water supply pipe 21.

The second water supply pipe 22 serves to supply water from the external water supply source to the tub 11, and a water supply valve 25 for controlling the water supply through the second water supply pipe 22 is provided at the middle of the second water supply pipe 22.

Thus, the water flowing through the second water supply pipe 22 is mixed with the detergent flowing from the discharge hole 41 of the detergent supply device 40 to the first water supply pipe 21, and the water and detergent mixture, i.e., the washing water, passes through the water softening apparatus 50. Then, the washing water softened by the water softening apparatus 50 is supplied to the tub 11.

The open time of the water supply valve 25 becomes equal to or similar to the open time of the detergent supply valve 23 by controlling the opening degree of the detergent supply valve 23. Thereby, the amount of the detergent mixed to the unit amount of the supplied water is reduced compared to the conventional washing machine, thus being capable of increasing the solubility of the detergent.

Figure 2:
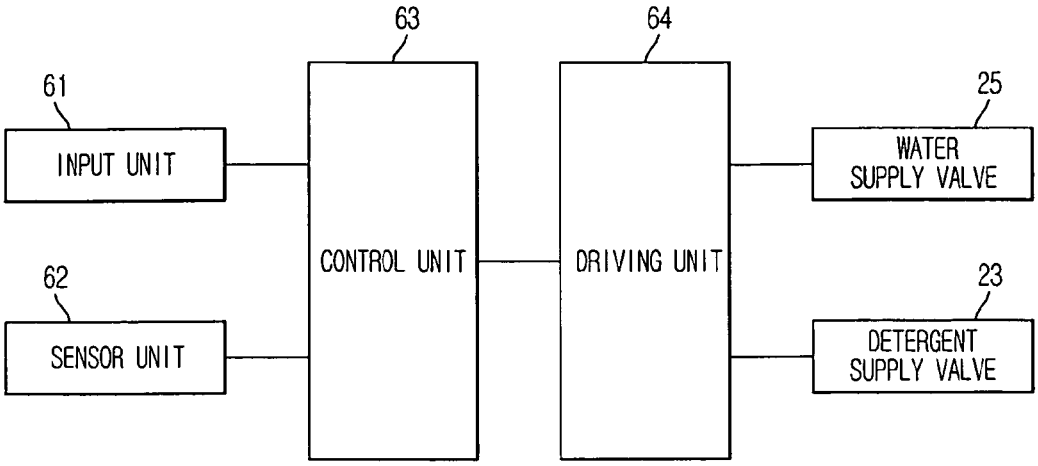
FIG. 2 is a control block diagram of the washing machine in accordance with one embodiment of the present invention.

FIG. 2 is a control block diagram of the washing machine in accordance with one embodiment of the present invention. The washing machine further includes an input unit 61, a sensor unit 62, a control unit 63, and a driving unit 64.

The input unit 61 inputs operation data, such as a washing course, a washing water level, a dehydrating RPM, whether or not rinsing is added, etc., which are selected by a user, to the control unit 63. The sensor unit 62 senses the amount of laundry put into the rotary drum 12, and includes a sensor for sensing the level of the washing water supplied to the tub 11, and preferably a sensor for sensing the amount of the detergent stored in the detergent supply device 40.

The control unit 63 is a microcomputer, which controls the washing machine based on the operation data inputted from the input unit 61. The control unit 63 determines the amount of water to be supplied according to the washing water level predetermined by the user or the amount of laundry sensed by the sensor unit 62 and thus sets the open time of the water supply valve 25, and controls the opening degree of the detergent supply valve 23 so as to discharge the detergent, received in the detergent supply device 40, to the tub 11 for the open time of the water supply valve 25, i.e., a time equal to or similar to a water supply time.

That is, in the case that it is supposed that the amount of the detergent stored in the detergent supply device 40 is regular, when the amount of the supplied water is large, the opening degree of the detergent supply valve 23 is decreased, and when the amount of the supplied water is small, the opening degree of the detergent supply valve is increased. Thereby, it is possible to allow the water supply time and the detergent supply time to be equally or similarly maintained.

A table of experimental values of the opening degree of the detergent supply valve 23 according to the water supply time may be prepared, and stored in the control unit 63.

Further, in the case that the amount of the detergent stored in the detergent supply device 40 is not regular, i.e., in the case that a user increases or decreases the amount of the detergent in the detergent supply device 40 in proportion to the amount of the supplied water, quantitative analysis data are calculated through experiments and thus it is possible to set a regular opening degree of the detergent supply valve 23 based on the data.

The control unit 63 receives the amount of the detergent in the detergent supply device 40 inputted from the sensor unit 62, and controls the opening degree of the detergent supply valve 23 based on the set water supply time such that the water supply time and the detergent supply time can be equalized.

The equalization of the water supply time and the detergent supply time causes the detergent to be continuously mixed with the supplied water during supplying water, thereby increasing the solubility of the detergent, compared with the case of that the detergent is mixed with water and the water mixed with the detergent is supplied to the tub in the initial stage of water supply and then only water is supplied to the tub, and thus improving the washing power of the washing machine and shortening a washing time.

The driving unit 64 drives the water supply valve 25 and the detergent supply valve 23 according to a driving control signal of the control unit 63.

Next, the water softening device of the washing machine of the present invention will be described.

The water softening device may be variously modified. First, a water softening device of a washing machine in accordance with a first embodiment of the present invention will be described.

Figure 3:
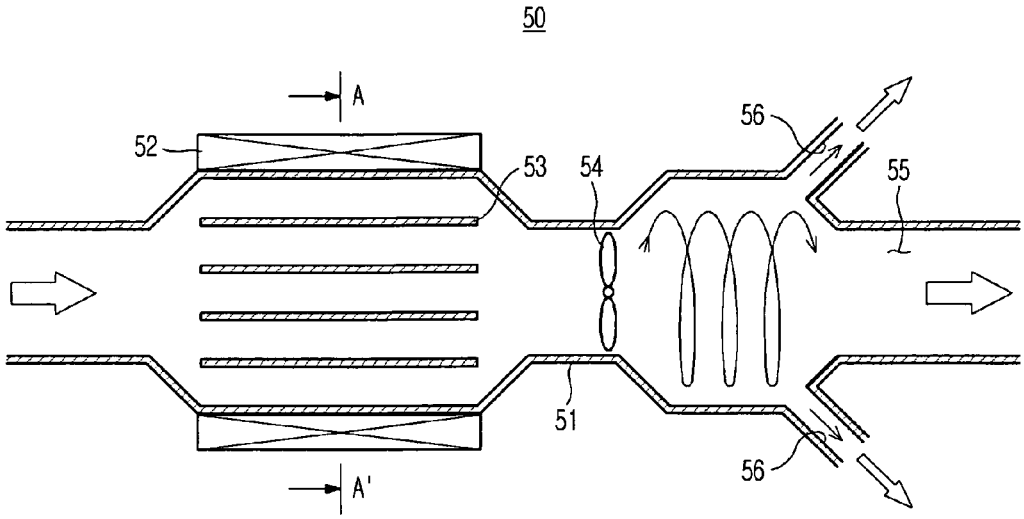
FIG. 3 is a cross-sectional view of a water softening device of a washing machine in accordance with a first embodiment of the present invention.
Figure 4:
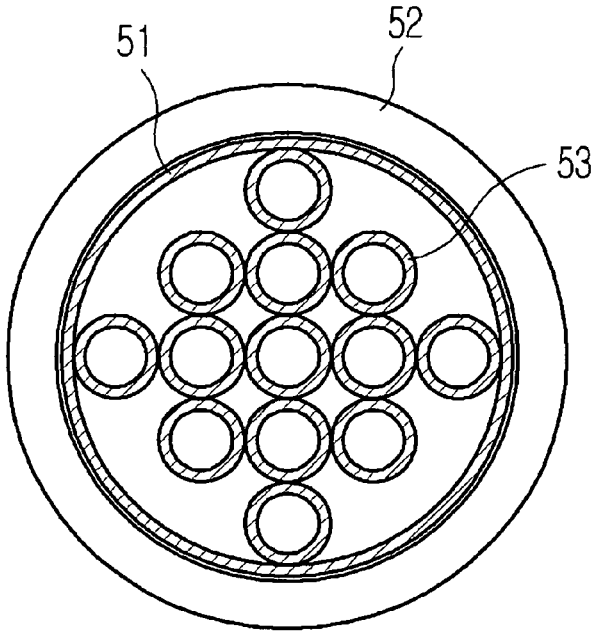
FIG. 4 is a cross-sectional view of FIG. 3 taken along the line A-A'.

FIG. 3 is a cross-sectional view of a water softening device of a washing machine in accordance with the first embodiment of the present invention, and FIG. 4 is a cross-sectional view of FIG. 3 taken along the line A-A'.

A water softening device 50 in accordance with the first embodiment, as shown in FIGS. 3 and 4, includes a water softening pipe 51 forming a space such that water mixed with a detergent can flow in the space, an electromagnet 52 surrounding the outer surface of the water softening pipe 51 and supplying magnetic force and heat to a fluid, and metal pipes 53 provided in the water softening pipe 51 and reacting with the electromagnet 51 to magnetize the water and emit heat.

The electromagnet 52 preferably uses a solenoid, and surrounds the outer surface of a certain area of the water softening pipe 51. The magnetic field of the electromagnet 52 magnetizes water and heat of the electromagnet 52 heats the metal pipes 53 and the water, thereby improving a water softening effect.

A plurality of the metal pipes 53 is provided in the water softening pipe 51 at a position corresponding to the electromagnet 52. The metal pipes 53 react with the electromagnet 52, and generate magnetic force and heating force to magnetize water and heat water concurrently, thereby converting hard water components of the water into salts and thus increasing a water softening effect.

The present invention heats water mixed with a detergent, and thus increases a water softening effect compared to a method in which water without a detergent is heated. That is, in the case that water without a detergent is heated to a designated temperature, it is possible to remove approximately 70% of temporary hard water components from the water, and in the case that water mixed with a detergent is heated to a designated temperature, it is possible to remove up to approximately 90% of temporary hard water components from the water.

An impeller 54, which strengthens a water current so as to prevent salts, generated by heating, from being accumulated on the inside of the water softening pipe 51, is provided at the side of outlets of the metal pipes 53. An axial flow fan is used as the impeller 54, and forms a water current, which moves forward in a spiral.

A soft water discharge hole 55 is formed through the center of an outlet of the water softening pipe 51, and a hard water discharge hole 56 is formed through the outlet of the water softening pipe 51 in the circumferential direction of the soft water discharge hole 55.

The salts formed in the water heated by the interaction between the electromagnet 52 and the metal pipes 53 are heavier than water molecules, and thus are concentrated in the circumferential direction, i.e., on a location close to the inner surface of the water softening pipe 51, by centrifugal force due to the spiral-shaped water current. Therefore, soft water, obtained by removing the salts from the water, remains around the central axis of the water softening pipe 51 and is supplied to the tub 11 through the soft water discharge hole 55, and water around the inner surface of the water softening pipe 51, on which the salts are concentrated, is discharged to the outside through the hard water discharge hole 56.

Further, the detergent mixed with the water has an improved dissolving capacity due to the irregular water current generated through the water softening pipe 51.

Consequently, compared to water supplied to the inside of a tub of a conventional washing machine, water supplied to the inside of the tub 11 increases the solubility of a detergent, and is softened and thus causes an enhancement in washing power, and prevents the generation of scale on the inside of the heater 17.

Hereinafter, a water softening device of a washing machine in accordance with a second embodiment of the present invention will be described.

Some parts of the water softening device in this embodiment, which are substantially the same as those in the first embodiment, are denoted by the same reference numerals even though they are depicted in different drawings, and a detailed description thereof will thus be omitted because it is considered to be unnecessary.

Figure 5:
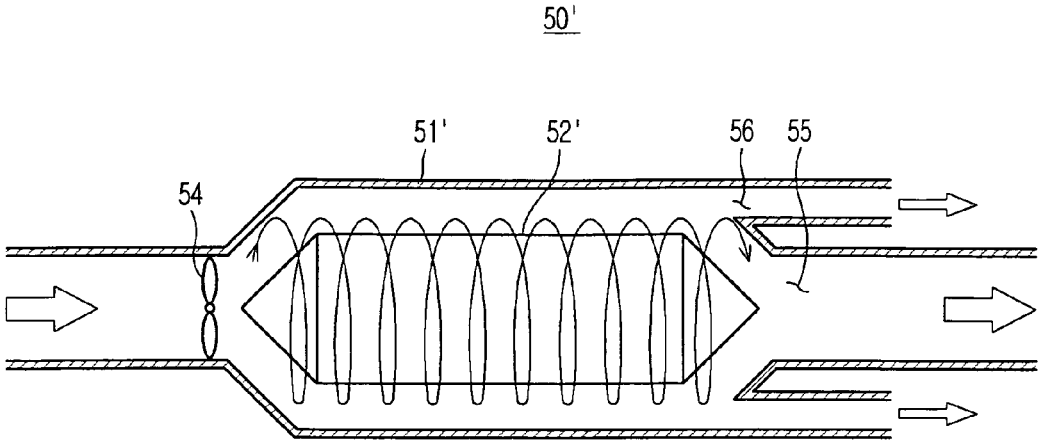
FIG. 5 is a cross-sectional view of a water softening device of a washing machine in accordance with a second embodiment of the present invention.

FIG. 5 is a cross-sectional view of a water softening device of a washing machine in accordance with the second embodiment of the present invention.

A water softening device 50' in accordance with the second embodiment, as shown in FIG. 5, includes a water softening pipe 51' forming a space such that water mixed with a detergent can flow in the space, and an ultraviolet and/or infrared generator 52' provided in the water softening pipe 51' for emitting ultraviolet and/or infrared rays.

It is known that ultraviolet rays remove permanent hard water components and infrared rays remove temporary hard water components. Accordingly, a water softening device may include an ultraviolet generator, an infrared generator, or an ultraviolet and infrared generator. When a water softening device includes an ultraviolet generator, the water softening device exhibits a sterilizing effect, which destroys germs, such as bacteria.

An impeller 54 is provided at the side of an inlet of the ultraviolet and/or infrared generator 52', and forms a water current, which moves forward in a spiral.

A soft water discharge hole 55 is formed through the center of an outlet of the water softening pipe 51', and a hard water discharge hole 56 is formed through the outlet of the water softening pipe 51' in the circumferential direction of the soft water discharge hole 55.

Thus, the water current moving forward in a spiral due to the driving of the impeller 54 is rotated along the ultraviolet and/or infrared generator 52' disposed in the center of the water softening pipe 51', and the irregular water current improves the dissolving capacity of the detergent contained in the water. Further, by centrifugal force, hard water components, which are comparatively heavy, are discharged to the hard water discharge hole 56, and soft water components are supplied to the tub 11 through the soft water discharge hole 55.

Hereinafter, a water softening device of a washing machine in accordance with a third embodiment of the present invention will be described.

Some parts of the water softening device in this embodiment, which are substantially the same as those in the first embodiment, are denoted by the same reference numerals even though they are depicted in different drawings, and a detailed description thereof will thus be omitted because it is considered to be unnecessary.

Figure 6:
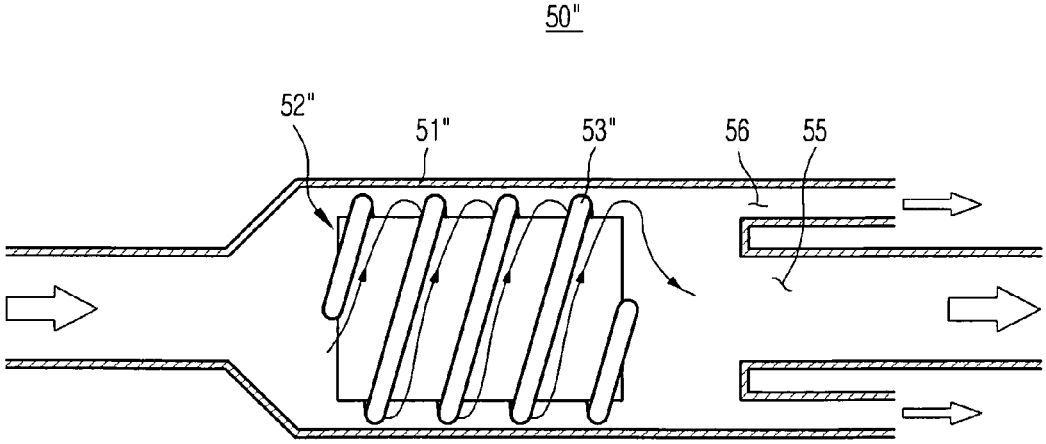
FIG. 6 is a cross-sectional view of a water softening device of a washing machine in accordance with a third embodiment of the present invention.

FIG. 6 is a cross-sectional view of a water softening device of a washing machine in accordance with the third embodiment of the present invention.

A water softening device 50" in accordance with the third embodiment, as shown in FIG. 6, includes a water softening pipe 51" forming a space such that water mixed with a detergent can flow in the space, a warm current generator 52" provided in the water softening pipe 51" for generating an irregular warm current in the water flowing through the water softening pipe 51", and a heater 53" formed on the outer circumferential surface of the warm current generator 52".

The heater 53" serves to heat the flowing water, thus exhibiting the above-described water softening effect.

Further, the warm current generator 52" reacts with the heater 53" spirally wound on the outer circumferential surface of the warm current generator 52", and generates a warm current in the water mixed with the detergent, thus increasing the solubility of the detergent.

A soft water discharge hole 55 is formed through the center of an outlet of the water softening pipe 51", and a hard water discharge hole 56 is formed through the outlet of the water softening pipe 51" in the circumferential direction of the soft water discharge hole 55.

Thus, the water mixed with the detergent flows into the water softening device 50", and is guided by the spiral heater 53", thereby producing a water current, which moves forward in a spiral. The irregular water current improves the dissolving capacity of the detergent contained in the water. Further, by centrifugal force due to the spiral water current, hard water components, which are comparatively heavy, are discharged to the hard water discharge hole 56, and soft water components are supplied to the tub 11 through the soft water discharge hole 55.

Hereinafter, a water softening device of a washing machine in accordance with a fourth embodiment of the present invention will be described.

Figure 7:
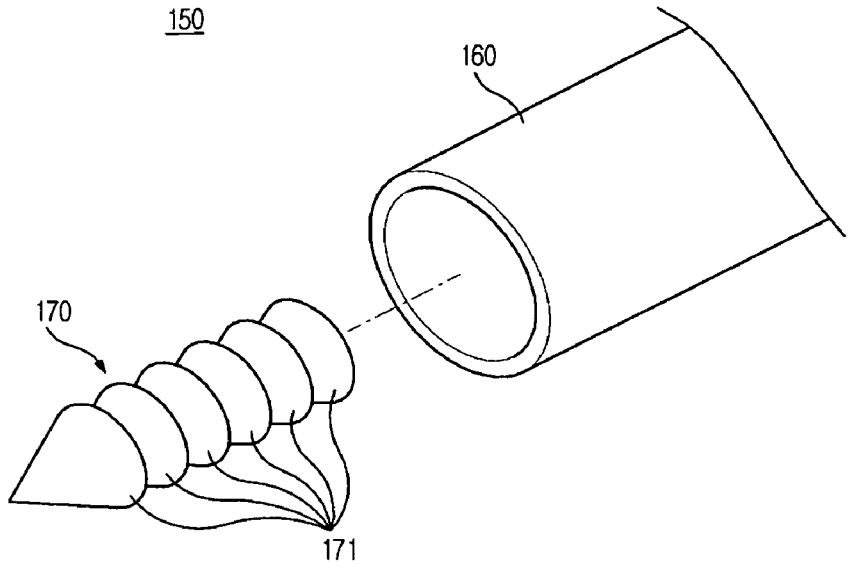
FIG. 7 is an exploded perspective view of a water softening device of a washing machine in accordance with a fourth embodiment of the present invention.
Figure 8:
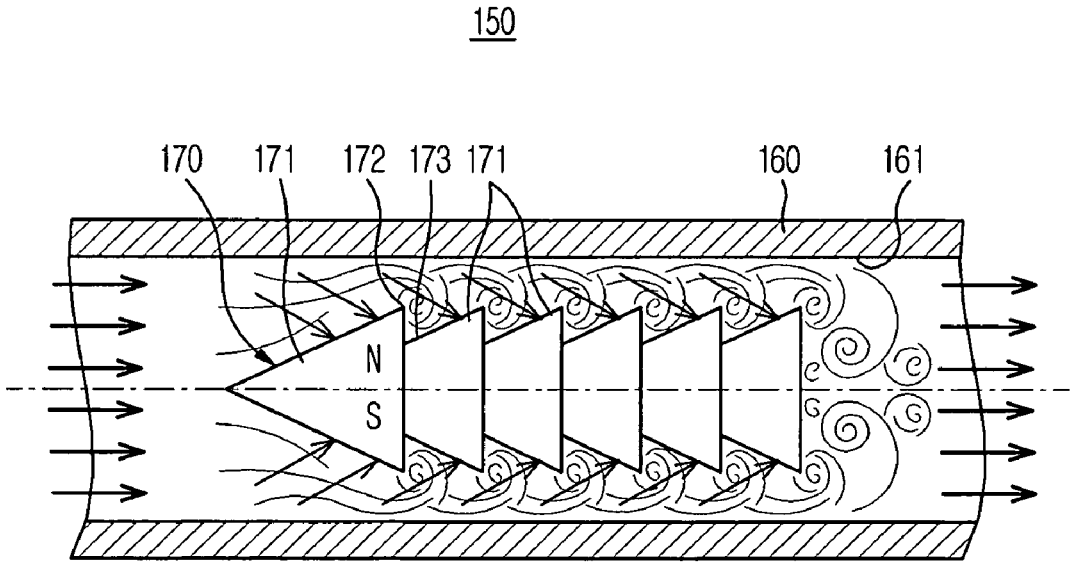
FIG. 8 is a cross-sectional view of the water softening device of FIG. 7.

FIG. 7 is an exploded perspective view of a water softening device of a washing machine in accordance with the fourth embodiment of the present invention, and FIG. 8 is a cross-sectional view of the water softening device of FIG. 7.

A water softening device 150 in accordance with the fourth embodiment, as shown in FIGS. 7 and 8, includes a tubular body 160 having a hollow pipe shape such that a fluid can flow therein, and a magnet 170 provided in the tubular body 160 and reacting with the tubular body 160 to form a magnetic flux The tubular body 160 is made of steel having magnetic force, and thus the magnetic flux is formed between the magnet 170 and an inner surface 161 of the tubular body 160.

The magnet 170 includes a plurality of tapered pieces 171, the diameter of which is increased in the flow direction of the fluid, and vortex forming parts 172 and 173 having a right triangular shape are formed on the outer circumferential surface of the magnet 170 including the tapered pieces 171 such that the fluid flowing along the vortex forming parts 172 and 173 form vortexes.

The tapered pieces 171 of the magnet 170 may be formed integrally, or be formed separately and then connected by washers (not shown).

The vortex forming parts 172 and 173 include outer circumferential parts 172 having the maximum diameter of the respective tapered pieces 171, and outer circumferential parts 173 having the minimum diameter of the respective tapered pieces 171 contacting the outer circumferential parts 172. Thus, water flowing into the tubular body 160 flows from the outer circumferential part 172 having the maximum diameter to the outer circumferential part 173 having the minimum diameter, and the cross-sectional area of a fluid channel is rapidly increased, thus producing a vortex. As described above, vortexes are formed by the vortex forming parts 172 and 173, and extend the flowing time of water in the tubular body 160, compared with the conventional water softening device, to increase the magnetization time of the water, makes the water flow to be unstable to improve a water softening performance, thereby preventing the formation of scale on the inner surface of the tubular body 160.

When hard water flows into the above-described water softening device of the present invention, Lorentz force is generated by the magnetic force. Lorentz force acts perpendicularly to the moving direction of ions contained in the hard water, and separates the ions from hydroxides. Thereby, magnesium ions or calcium ions are separated from the hard water, and then the hard water is converted into soft water.

Hereinafter, a water softening device of a washing machine in accordance with a fifth embodiment of the present invention will be described.

Figure 9:
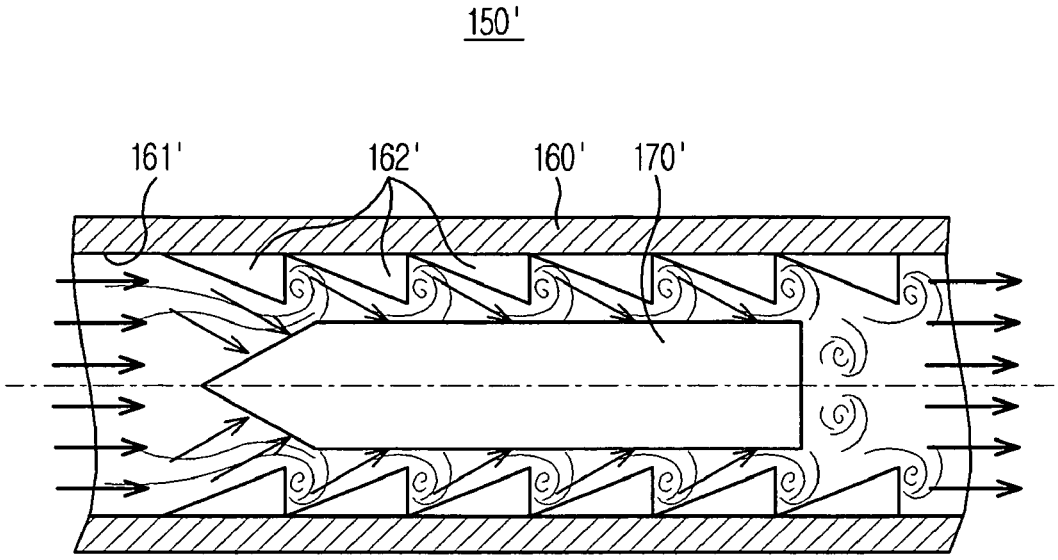
FIG. 9 is a cross-sectional view of a water softening device of a washing machine in accordance with a fifth embodiment of the present invention.

FIG. 9 is a cross-sectional view of a water softening device of a washing machine in accordance with the fifth embodiment of the present invention.

A water softening device 150' in accordance with the fifth embodiment, as shown in FIG. 9, includes a tubular body 160' having a hollow pipe shape such that a fluid can flow therein, and a magnet 170' having a cylindrical shape provided in the tubular body 160' and reacting with the tubular body 160' to form a magnetic flux The tubular body 160' is made of steel having magnetic force, and thus the magnetic flux is formed between the magnet 170' and the inside of the tubular body 160'.

Vortex forming parts 162' having a ring shape, such that the diameter of a fluid channel of each of the vortex forming parts 162' is decreased in the flowing direction of water, are provided on an inner surface 161' of the tubular body 160', in which the magnet 170' is located.

The vortex forming parts 162' have a saw-toothed section. Hard water passes through the vortex forming parts 162', and generates vortexes, thus extending the flowing time of the water in the tubular body 160', in which the magnet 170' is installed. Accordingly, the vortex forming parts 162' increase the magnetization time of water, making the water flow unstable to improve a water softening performance, thereby preventing the formation of scale on the inside of the tubular body 160'.

Hereinafter, a water softening device of a washing machine in accordance with a sixth embodiment of the present invention will be described.

Figure 10:
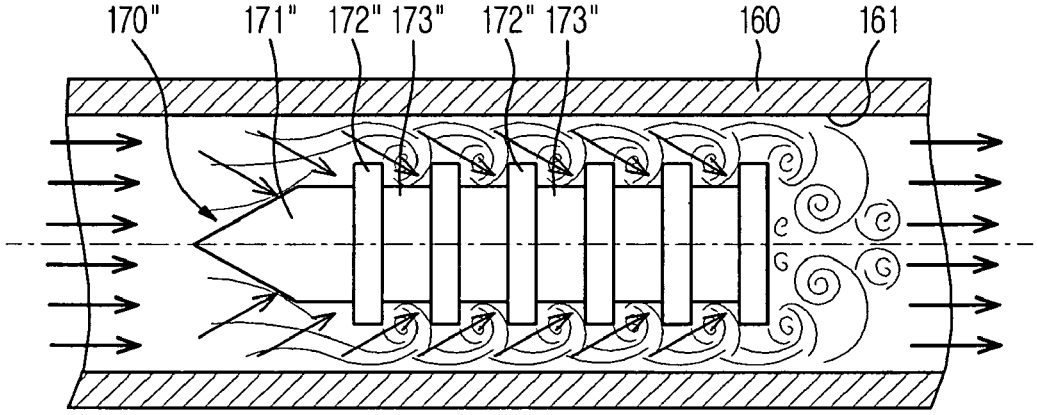
FIG. 10 is a cross-sectional view of a water softening device of a washing machine in accordance with a sixth embodiment of the present invention.

FIG. 10 is a cross-sectional view of a water softening device of a washing machine in accordance with the sixth embodiment of the present invention.

A water softening device 150" in accordance with the sixth embodiment, as shown in FIG. 10, includes a tubular body 160", and a magnet 170" provided in the tubular body 160". The magnet 170" includes a plurality of cylindrical parts 172" and 173" having different diameters that are connected to the magnet 170" such that hard water passes through the cylindrical parts 172" and 173" and generates vortexes, and vortex forming parts are provided between the outer circumferential surfaces of the cylindrical parts 172" and 173" and an inner surface 161" of the tubular body 160".

Preferably, the magnets 170" includes a head part 171" guiding a water current, and first cylindrical parts 172" having a relatively large diameter and second cylindrical parts 173" having a relatively small diameter, which are disposed alternately, thus having an uneven surface.

The above-described vortex forming parts are not limited to the above embodiments, but may have various shapes for forming vortexes.

The washing machine having the water softening device of the present invention controls a detergent supply time so as to correspond to a water supply time, and decreases the amount of a detergent mixed with the unit amount of supplied water, thus being capable of improving the dissolving capacity of the detergent in the water.

Further, the water softening device is provided at a position in the washing machine, into which water mixed with the detergent can flow, forms a spiral water current so as to improve a water softening effect, and improves the solubility of the detergent so as to reduce a washing time and increase washing power.

Further, vortex forming parts, which are provided between a tubular body and a magnet disposed in the tubular body such that water flowing in the tubular body forms vortexes, extend the magnetization time of the water passing the magnet and make the water flow to be irregular, thus improving a water softening performance.

Further, various water softening devices in accordance with embodiments of the invention do not require periodic supply of salt, as the conventional water softening device using ion exchange resin, and do not require regenerating operation, as the conventional water softening device using CDI, thus improving customer's convenience.

Although the above embodiments describe the water softening devices installed in a washing machine, the water softening devices may be installed at a water inlet or a water outlet of a water purifier, be connected directly to a tap in a kitchen or a bathroom, and be installed in other electric home appliances using water, such as a dishwasher.

Next, a washing machine in accordance with another embodiment of the present invention will be described.

Some parts of the washing machine in this embodiment, which are substantially the same as those in the preceding embodiment, are denoted by the same reference numerals even though they are depicted in different drawings, and a detailed description thereof will thus be omitted because it is considered to be unnecessary.

Figure 11:
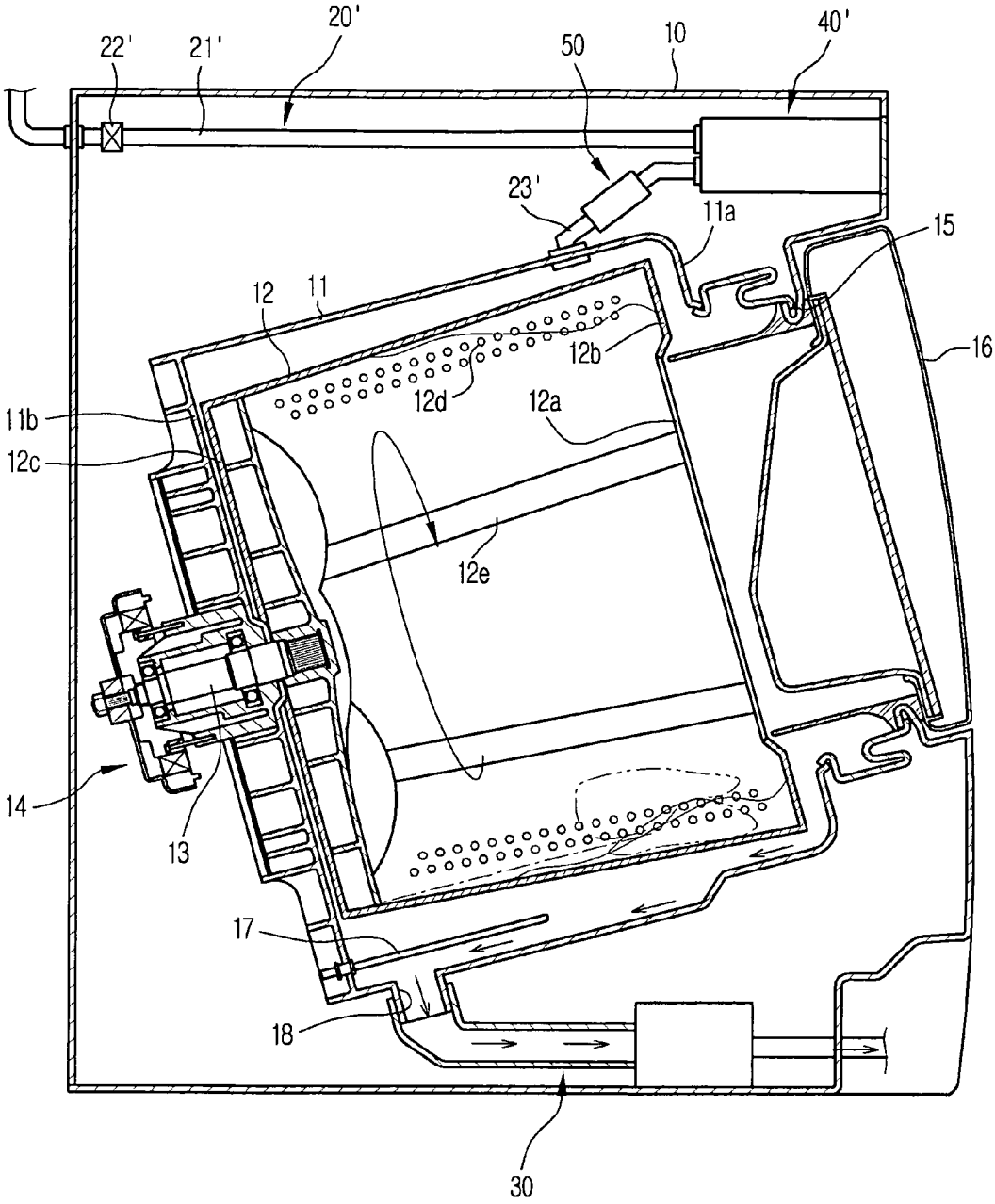
FIG. 11 is a schematic sectional view of a washing machine in accordance with another embodiment of the present invention.

FIG. 11 is a schematic sectional view of a washing machine in accordance with another embodiment of the present invention.

The configuration of a washing machine in this embodiment, as shown in FIG. 11, is the same as that of the washing machine in the preceding embodiment except for a water supply device and a detergent supply device.

A water supply device 20' includes a first water supply pipe 21' provided with one end connected to a water supply source and the other end connected to a detergent supply device 40', a water supply valve 22' provided at the middle of the first water supply pipe 21' for controlling the supply of water through the first water supply pipe 21', and a second water supply pipe 23' provided between the detergent supply device 40' and the tub 11 for supplying water, passed through the detergent supply device 40', to the tub 11.

The detergent supply device 40' has a receipt space having an approximately rectangular shape for containing a detergent.

The water softening device 50 is installed at the middle of the second water supply pipe 23'. Here, various water softening devices in accordance with embodiments of the invention may be used.

Water flowing through the first water supply pipe 21' passes through the detergent supply device 40' so that the water can be mixed with the detergent in the detergent supply device 40', and the water mixed with the detergent flows through the second water supply pipe 23'.

The water mixed with the detergent, which flows through the second water supply pipe 23', passes through the water softening device 50 so that the solubility of the detergent in the water is increased and the water is converted into soft water, and then the soft water is supplied to the tub 11.

Accordingly, compared to the preceding embodiment, the washing machine of this embodiment softens hard water and increases the solubility of the detergent with a relatively simple configuration.

As apparent from the above description, the washing machine having the water softening device of the present invention controls a detergent supply time so as to correspond to a water supply time, and decreases the amount of a detergent mixed with the unit amount of supplied water, thus being capable of improving the dissolving capacity of the detergent in the water.

The water softening device is provided at a position in the washing machine, into which water mixed with the detergent can flow, forms a spiral water current so as to improve a water softening effect, and improves the solubility of the detergent so as to reduce a washing time and increase washing power.

Vortex forming parts, which are provided between a tubular body and a magnet disposed in the tubular body such that water flowing in the tubular body forms vortexes, extend the magnetization time of the water passing the magnet and make the water flow to be irregular, thus improving a water softening performance.

The water softening device allows water to be softened through a water softening pipe having a tubular shape, and thus has a compact size.

The water softening device does not require a periodic supply of salt, as the conventional water softening device using ion exchange resin does, and does not require a regenerating operation as does the conventional water softening device using CDI, thus improving customer's convenience.

The water softening device ionizes magnesium and calcium of hydroxides and thus removes scale from the inner wall of the tubular body, and prevents the formation of scale.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a tub;

a water supply device to supply water to the tub;

a detergent supply device to supply a detergent to the tub; and a water softening device to soften the water and increase the solubility of the detergent, the water softening device being disposed such that the water supplied from the water supply device is mixed with the detergent supplied from the detergent supply device, then the water mixed with the detergent is supplied to the water softening device, and then the softened water mixed with the detergent is supplied to the tub, wherein the water supply device includes a first water supply pipe connecting a water supply source and an inlet of the detergent supply device, and a second water supply pipe connecting the detergent supply device and the tub, and the water softening device is installed at the middle of the second water supply pipe, and whereby as only softened water passes into the tub, scale is prevented from accumulating where the softened water enters the tub.

2. The washing machine according to claim 1, further comprising a control unit to control the opening degree of a detergent supply valve according to the amount of the water supplied from the second water supply pipe.

3. The washing machine according to claim 1, wherein the water softening device includes a water softening pipe, in which the water mixed with the detergent flows, and a water softening unit to soften the water flowing in the water softening pipe.

4. The washing machine according to claim 3, wherein the water softening unit includes an electromagnet surrounding the outer surface of the water softening pipe to supply magnetic force and heat to a fluid, and a plurality of metal pipes provided in the water softening pipe and reacting with the electromagnet to magnetize the water.

5. The washing machine according to claim 3, wherein the water softening unit includes an ultraviolet and/or infrared generator provided in the water softening pipe to generate ultraviolet and/or infrared rays.

6. The washing machine according to claim 3, wherein the water softening unit includes a warm current generator to generate a warm current, and a heater to heat the water flowing in the water softening pipe.

7. The washing machine according to claim 4 or 5, wherein the water softening device further includes an impeller to generate a forcible flow to prevent the accumulation of scale on the inside of the water softening pipe.

8. The washing machine according to claim 7, wherein the impeller is an axial flow fan forming a water current, which moves forward in a spiral, to move hard water components to the outer circumference of the water softening pipe.

9. The washing machine according to any one of claims 4 to 6, wherein a soft water discharge hole is formed through the center of an outlet of the water softening pipe, and a hard water discharge hole is formed through the outlet of the water softening pipe in the circumferential direction of the soft water discharge hole.

10. The washing machine according to claim 1, wherein the water softening device includes a tubular body having magnetic force, a magnet provided in the tubular body, and vortex forming parts to form vortexes and magnetize water flowing in the tubular body so as to improve a water softening performance.

11. The washing machine according to claim 10, wherein the vortex forming parts are provided on at least one of the tubular body and the magnet.

12. The washing machine according to claim 10, wherein the vortex forming parts have the shape of a plurality of tapered pieces.

13. The washing machine according to claim 10, wherein the vortex forming parts have a saw-toothed or uneven shape.

14. The washing machine according to claim 10, wherein the vortex forming parts have a right triangular shape.

15. The washing machine according to claim 10, wherein the vortex forming parts comprise a plurality of cylindrical parts formed on the magnet, the cylindrical parts having a greater diameter than the magnet and being spaced at predetermined intervals along a length of the magnet.

16. The washing machine according to claim 10, wherein a front end of the magnet is tapered.

* * * * *